United States Patent [19]

Ichida et al.

[11] Patent Number: 4,882,923

[45] Date of Patent: Nov. 28, 1989

[54] CONTINUOUS MILL PLANT FOR ROLLING STEEL PLATES

[75] Inventors: Kozaburo Ichida; Susumu Yamaguchi; Bunichiro Chikazawa, all of Kitakyushu, Japan

[73] Assignee: Nippon Steel Corporation, Tokyo, Japan

[21] Appl. No.: 319,828

[22] Filed: Mar. 3, 1989

Related U.S. Application Data

[63] Continuation of Ser. No. 214,872, Jul. 5, 1988, abandoned, which is a continuation of Ser. No. 831,953, Feb. 24, 1986, abandoned.

[30] Foreign Application Priority Data

Feb. 25, 1985 [JP] Japan ..... 60-34533

[51] Int. Cl.[4] ..... B21B 35/04

[52] U.S. Cl. ..... 72/249; 72/29; 72/234

[58] Field of Search ..... 72/249, 234, 226, 205, 72/29

[56] References Cited

U.S. PATENT DOCUMENTS

| | | | |
|---|---|---|---|
| 1,716,039 | 6/1929 | Fries | 72/29 |
| 2,131,541 | 9/1938 | Pease et al. | 72/29 |
| 3,074,300 | 1/1963 | Justus | 72/29 |
| 3,213,656 | 10/1965 | Cook | 72/234 X |
| 3,655,950 | 4/1972 | Greening et al. | 72/249 X |
| 3,762,194 | 10/1973 | Maxwell | 72/29 X |
| 3,861,188 | 1/1975 | Kamit et al. | 72/234 |
| 3,913,368 | 10/1975 | Eibe | 72/234 |

*Primary Examiner*—Robert L. Spruill
*Assistant Examiner*—Steven B. Katz
*Attorney, Agent, or Firm*—Pollock, Vande Sande & Priddy

[57] ABSTRACT

A continuous mill plant for rolling steel plates having one or a plurality of rolling mills. The ratio of maximum rolling speed to minimum rolling speed of the plant is at least 3.0 but no more than 10.0 at the continuous rated output of an electric motor for driving the rolling mill.

7 Claims, 3 Drawing Sheets

PRIOR ART

PRIOR ART

CONTINUOUS MILL PLANT FOR ROLLING STEEL PLATES

This application is a continuation of Ser. No. 214,872, filed on July 5, 1988, abandoned, which was a continuation of prior application Ser. No. 831,953, filed on Feb. 24, 1986, abandoned, and entitled Continuous Mill Plant for Rolling Steel Plates.

BACKGROUND OF THE INVENTION (1) Field of the Invention

The present invention relates to a continuous mill plant for rolling steel plates which is designed to work at the minimum rolling power.

(2) Description of the Prior Art

Electric motors in general include direct-current motors and alternating-current motors. To date, most of the motors which have been used in rolling mills have been direct-current motors, since sufficient frequency conversion techniques have not been developed for controlling the speed of alternating-current motors. However, increases in capacity of direct-current motors have been limited in terms of commutating ability.

The characteristics of such a conventional direct-current motor for rolling will be described with reference to accompanying drawings. FIG. 4 relates to one of the standard types of conventional continuous mill plant for rolling steel plates, namely, a 5-stand tandem rolling mill plant for producing cold-rolling steel plates of medium and increased thickness. The ordinate represents rolling speeds, and each number of the abscissa represents rolling mills. In this figure are depicted a line (lower limit) connecting the minimum rolling speed points and a line (upper limit) connecting the maximum rolling speed points defined at the continuous rated output of a motor for driving each rolling mill. The form of an area between the lower and upper limit lines in each figure is hereinafter referred to as a speed cone, and the ratio of maximum rolling speed to minimum rolling speed is referred to as the rolling speed ratio. The rolling speed ratio of a steel rolling mill plant is generally about 2.0 and less than 3.0, as shown in "Iron and Steel Manual" (Vol. 3) (2) (Nov. 20, 1980) edited by The Iron and Steel Institute of Japan, Maruzen, p. 1349. This value is due to the limitation in current rate of a direct-current motor based on the commutating ability described above.

From such speed cone characteristics of a rolling mill plant using a direct-current motor, a conventional method of, for example, producing cold-rolled steel plates involves a plurality of rolling mill plant rows such as rolling mill plants for processing thin and thick materials, respectively. The range of dimensions and qualities of a steel plate processed by each of these rolling mill plants are set to be comparatively narrow so as to correspond to a rolling speed ratio of less than 3.0. This arrangement has been necessitated by the need to produce different types of products of differing thicknesses.

The relationship between speed cone characteristic and degree of rolling is described below with respect to rolling mill plants for respectively processing thin and thick materials. In a rolling mill plant for thick material, a speed cone is such as shown in FIG. 6, since the ratio of the original plate thickness (of a material to be processed before rolling) to the product thickness after rolling, namely, the rolling reduction ratio, is small, as shown, for example, at Nos. 3 to 14 in Table 2, the difference between rolling speeds at the initial and final rolling mills thereby is small. Conversely, in a rolling mill plant for thin material having a speed cone such as shown in FIG. 7, the rolling reduction ratio is large, as shown, for example, at Nos. 1 and 2 in Table 2. In both cases, it is possible for material adapted to each design to be rolled within the area of speed cones, and the power of rolling mills is used efficiently.

On the other hand, when thick and thin materials are processed by a conventional rolling mill plant of either the type for processing thick material or the type for thin material with a view to eliminating or reducing the investment in labor and installations from the level currently needed, there is a problem of difficulty in performing rolling or of inefficient use of rolling mill power.

In a rolling mill plant for processing thick material and having such speed cone as shown in FIG. 6, when a thin material such as, for example, shown at Nos. 1 and 2 in Table 2 is rolled, the rolling speed is restricted to the upper limit of the speed cone at the final stand and so at each of the first to fourth stands even though there is some power margin. The rolling speed at the first stand is thereby reduced below the lower limit of the speed cone. Thus, the power of the rolling mill is not efficiently used, and the efficiency of production is considerably reduced compared with the rolling performed by rolling mill plants for processing thin material.

Conversely, when a thick material such as, for example, shown at No. 14 in Table 2 is rolled by a rolling mill plant for processing thin material and having a speed cone such as shown in FIG. 7, the rolling speed at all rolling stands can not be raised to the lower limit of the speed cone, the rolling itself thereby being extremely difficult.

Thus, in the conventional rolling mill plants, there are severe restrictions on the ranges of dimensions and qualities of a material to be rolled. There has not been any known practical techniques which would enable a single rolling mill plant to operate over the whole processing range without this defect.

SUMMARY OF THE INVENTION

The present invention provides a continuous mill plant for rolling steel plates which ensures that materials to be processed, which has a wide range of dimensions and qualities are rolled effectively by using the power of rolling mills.

TABLE 1

| No. | Original plate thickness | Product thickness | Width | Rolling reduction ratio |
|---|---|---|---|---|
| 1 | 2.3 | 0.25 | 35 | 9.2 |
| 2 | 2.3 | 0.30 | 35 | 7.7 |
| 3 | 2.5 | 0.70 | 35 | 3.6 |
| 4 | 2.5 | 0.70 | 50 | 3.6 |
| 5 | 2.5 | 0.70 | 65 | 3.6 |
| 6 | 3.0 | 1.00 | 35 | 3.0 |
| 7 | 3.0 | 1.00 | 50 | 3.0 |
| 8 | 3.0 | 1.00 | 65 | 3.0 |
| 9 | 3.5 | 1.40 | 50 | 2.5 |
| 10 | 3.5 | 1.40 | 50 | 2.5 |
| 11 | 4.5 | 2.30 | 65 | 2.0 |
| 12 | 4.5 | 2.30 | 65 | 2.0 |
| 13 | 6.0 | 3.20 | 65 | 1.9 |
| 14 | 6.0 | 3.20 | 80 | 1.9 |

Unit: mm

TABLE 2

| No. | Original plate thickness | Product thickness | Width | Rolling reduction ratio |
|---|---|---|---|---|
| 1 | 2.3 | 0.25 | 700 | 9.2 |
| 2 | 2.3 | 0.30 | 700 | 7.7 |
| 3 | 2.5 | 0.70 | 700 | 3.6 |
| 4 | 2.5 | 0.70 | 1000 | 3.6 |
| 5 | 2.5 | 0.70 | 1300 | 3.8 |
| 6 | 3.0 | 1.00 | 700 | 3.0 |
| 7 | 3.0 | 1.00 | 1000 | 3.0 |
| 8 | 3.0 | 1.00 | 1300 | 3.0 |
| 9 | 3.5 | 1.40 | 1000 | 2.5 |
| 10 | 3.5 | 1.40 | 1000 | 2.5 |
| 11 | 4.5 | 2.30 | 1300 | 2.0 |
| 12 | 4.5 | 2.30 | 1300 | 2.0 |
| 13 | 6.0 | 3.20 | 1300 | 1.9 |
| 14 | 6.0 | 3.20 | 1600 | 1.9 |

Unit: mm

The present invention essentially involves a continuous mill plant for rolling steel plates in which the ratio of maximum rolling speed to minimum rolling speed, namely, the rolling speed ratio, is at least 3.0 but no more than 10.0 at the continuous rated output of an electric motor for driving one or a plurality of rolling mills.

According to the present invention, the continuous rated output of an electric motor adapted to rolling mills for rolling materials having a wide range of dimensions and qualities can be greatly reduced compared with the conventional continuous mill plant; and rolling mill plants for respectively processing thick and thin materials can be integrated into one rolling mill plant.

Next, the reason for limiting the values is described. A speed-varying transmission and a final reduction gear are provided between a motor and a roll, and a rolling mill whose minimum and maximum rolling speeds at the continuous rated output of the motor for driving the roll can be freely changed from 5 mpm to 100 mpm is employed for testing. Then, materials shown in Table 1 are rolled respectively at the rolling speed ratios of 2.0, 2.5, 3.0, 4.0, 5.0, 6.0, 7.0, 8.0 and 10.0 through five passes of the original plate thickness to the product thickness. From rolling speeds measured at each pass, each continuous rated output of the motor necessitated when materials shown in Table 2 are rolled by the single rolling mill plant at the prescribed efficiency and rate is calculated, and the relationship between the rolling speed ratio and the continuous rated output of the motor is shown in FIG. 3 by assuming that the continuous rated output ratio of the motor is 1.0 at the rolling speed ratio of 2.5. As is shown in this figure, in the region of small rolling speed ratios, the rolling operation deviated from the rated output is necessitated by the need to process materials of differing thicknesses so that the rated output is set largely in safety by adding a desired margin, since the ranges of dimensions and qualities of the material to be processed are narrow. When the rolling speed ratio is large, the degree of freedom of selecting and adapting the rolling speeds suitable for dimensions and qualities of the material to be processed is increased, so that the irregular use of the motor deviating from the rating can be reduced, the continuous rated output of the motor thereby being reduced comparatively.

Thus, when the rolling speed ratio becomes lower than 3.0, the ratio of required continuous rated output of the motor increases abruptly. When the former is between 3.0 and 10.0, the latter decreases gradually and stably. When the former is equal to or more than 5.0, the latter becomes less than 0.6 so as to heighten the effect of limiting the motor capacity. The ratio of required continuous rated output saturates when the rolling speed ratio is above 10.0. Consequently, the suitable rolling speed ratio is at least 3.0 but no more than 10.0 and is preferably 5.0 or more and not more than 10.0.

DESCRIPTION OF THE PREFERRED EMBODIMENTS

Figure 5:
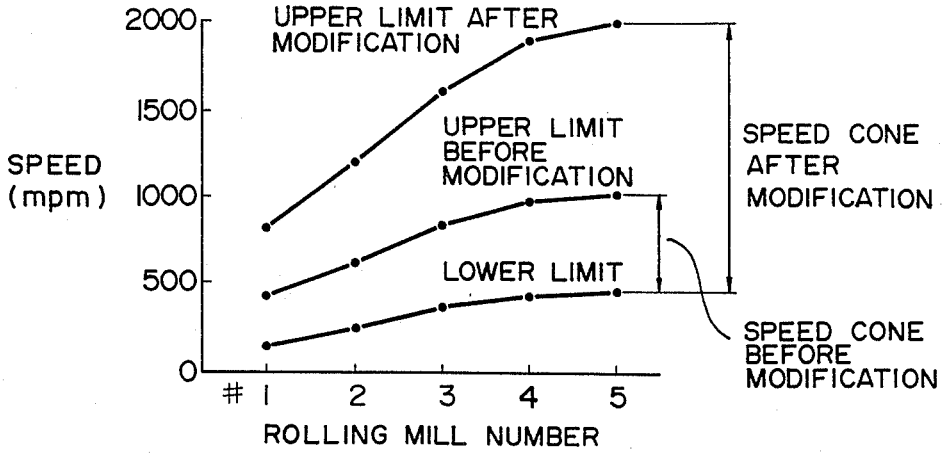
FIG. 5 is a diagram showing a speed cone of a rolling mill modified according to the present invention.
Figure 6:
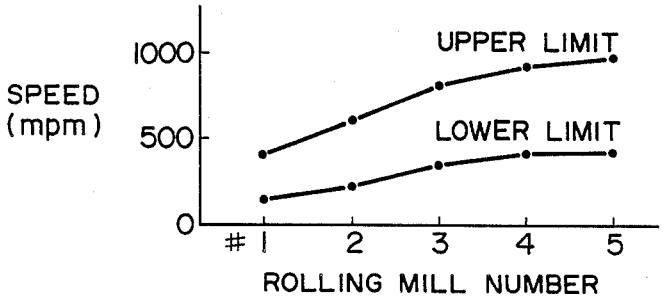
FIG. 6 is a diagram showing a speed cone of the conventional rolling mill plant for rolling a thick material.
Figure 7:
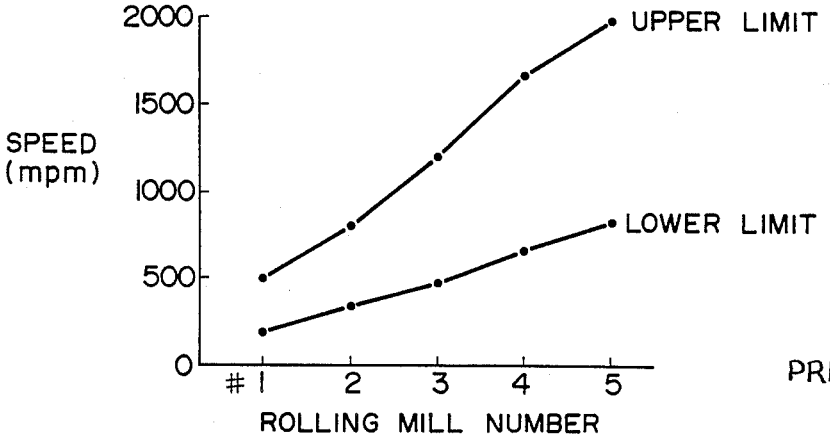
PRIOR ART FIG. 7
FIG. 7 is a diagram showing a speed cone of the conventional rolling mill plant for rolling a thin material.

FIG. 5 shows a speed cone of a rolling mill plant for rolling thick material whose rolling speed ratio is 2.5, and which is modified by the provision of transmissions at each stand and changing the speed ratio at each stand individually so as to obtain a rolling speed ratio of 5.0, thereby assuring that materials of wide ranges of dimensions and qualities can be rolled.

Figure 1:
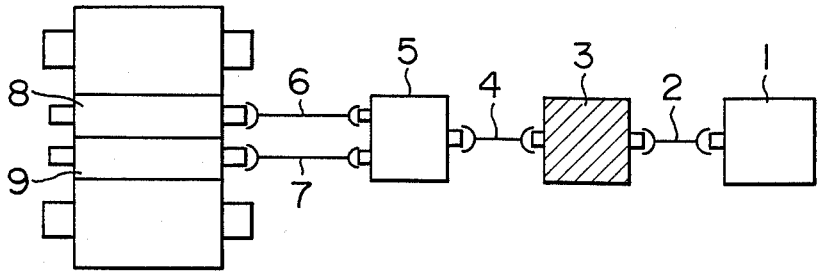
FIG. 1 is a front view showing a rolling mill which is an embodiment of the present invention.

FIG. 1 is a front view of a rolling mill provided by modifying a conventional rolling mill for a thick material on the basis of the present invention. The power generated by a direct-current motor 1 is supplied through a first intermediate shaft 2 to a speed-varying transmission 3 (hatched), and through a second intermediate shaft 4 to a final reduction gear 5. The rest of the rolling mill is the same as it was before the modification.

As a result, thin materials such as those shown at Nos. 1 and 2 in Table 2, which are processed at an extremely low efficiency by conventional rolling, are efficiently rolled by the above arrangement. Thus all the materials shown in Table 2 can be processed without having to increase the capacity of a conventional direct-current motor having a continuous rated output which is only 55% of the continuous rated output required when materials of differing thicknesses are processed at appropriate production efficiencies, when employing a single rolling mill plant whose rolling speed ratio is 2.5 as the conventional level. The results obtained by this processing are the same as those obtained by a rolling mill plant using direct-current motors of a desired continuous rated output level.

Recent improvements in the performance of semiconductors and computers have made the process of converting the frequency of a power source easier. The controllability of alternating-current motors are thereby so greatly improved that they can be used as motors for driving a rolling mill plant. Regarding speed control of alternating-current motors, there are pole changing control and frequency changing control. The pole changing control is not used except for discontinuous speed of alternating-current motor, and so such frequency changing control is indispensable for the continuous mill plant for rolling steel plates with minute speed control such as tension control between rolling stands is required.

An alternating-current motor which affords a rolling speed ratio of 5.0 has been adapted so that it can be substituted for a direct-current motor in the conventional rolling mill plant, resulting in the same effects without having to provide any speed-varying transmission of the above modification which enables materials of differing thicknesses to be easily rolled.

Figure 2:
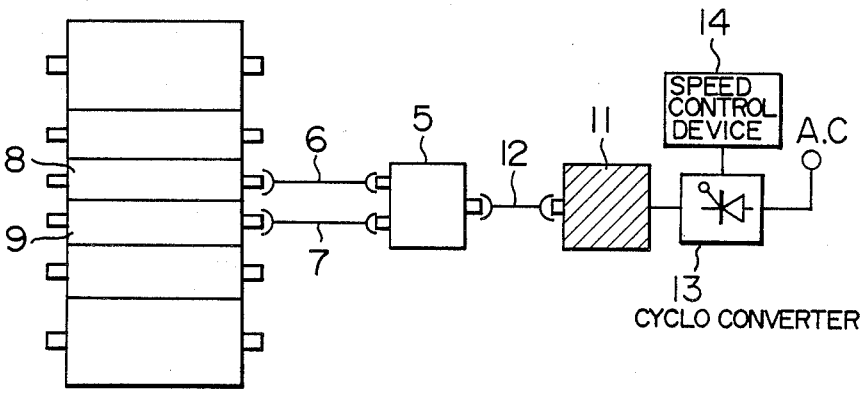
FIG. 2 is a front view showing a rolling mill which is another embodiment of the present invention.
Figure 3:
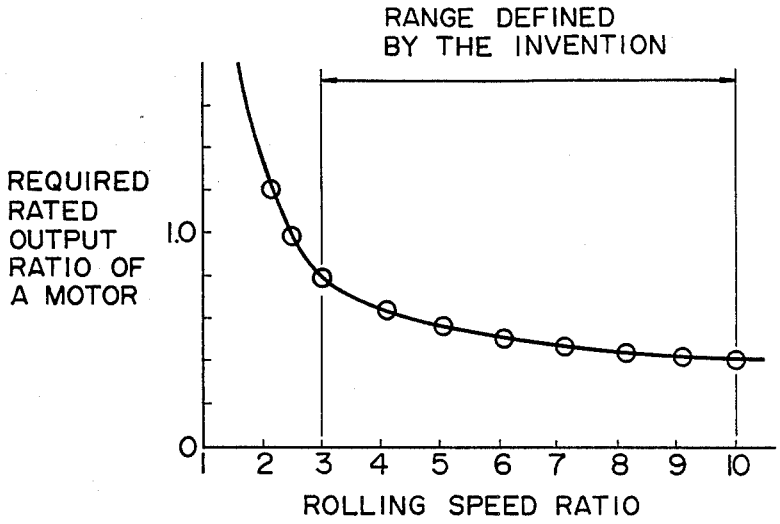
FIG. 3 is a diagram showing the relationship between the ratio of the required continuous rated output of a motor and the rolling speed ratio.
Figure 4:
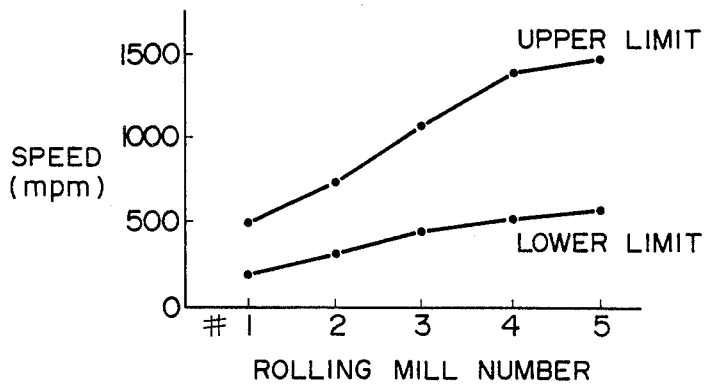
FIG. 4 is a diagram showing a general speed cone of a continuous mill plant for rolling steel plates.

FIG. 2 shows another embodiment of the present invention, in which an alternating-current motor whose rolling speed ratio is 9.0 is adapted to a 6-high rolling mill. An alternating-current motor 11 (hatched) is driven with the output power from a cycloconverter 13. Output frequency from a cycloconverter 13 is adjusted by using a speed-control device 14 in case that changing of rolling speed is required. The power is transmitted through an intermediate shaft 12, a final reduction gear 5, and upper and lower spindles 6 and 7 to an upper work roll 8 and a lower work roll 9.

In this way, an alternating-current motor having a rolling speed ratio of 9.0 has been adapted, and the desired productivity has been obtained in the processing of both thick and thin materials, the continuous rated output of the motor being reduced by 25% of that of an alternating-current motor adapted so as to have a rolling speed ratio of 5.0.

What is claimed is:

1. A continuous mill plant for producing steel plates having a ratio of maximum rolling speed to minimum rolling speed variable from at least 3.0 to no more than 10.0 at a continuous rated output of at least one alternating current electric motor for driving at least one rolling mill, and means for controlling the speed of said motor in accordance with said ratio such that the one rolling mill is adaptable to roll materials of different thicknesses.

2. A continuous mill plant for producing steel plates wherein a speed-varying transmission is provided between at least one rolling mill and at least one alternating current electric motor so as to effect a variable ratio of maximum rolling speed to minimum rolling speed of at least 3.0 to no more than 10.0 at a continuous rated output of the at least one electric motor for driving the at least one rolling mill; whereby the rolling mill is adaptable to roll materials of different thicknesses.

3. A continuous mill plant for producing steel plates according to any of claims 1 or 2, wherein said rolling mill is a rolling mill for cold-rolling steel plate.

4. A continuous mill plant for producing steel plates comprising:

at least one alternating current electric motor;

at least one rolling mill having a rolling speed ratio with a value of less than 3.0;

gear means connecting an output of the electric motor to the rolling mill for controlling the speed of the rolling mill;

speed controlling means for modifying the value of the rolling speed ratio to a value between 3.0 and 10.0;

wherein the rolling speed ratio value of the mill plant may be adjusted between 3.0 to 10.0 such that the mill plant can process materials of different thicknesses.

5. A continuous mill plant according to claim 5 further comprising:

converter means interposed between the electric motor and the speed control means for providing power to the electric motor, the power being dependent of an output frequency from the converter means, the frequency being adjusted by the speed controlling means for controlling the speed of the electric motor in the event that a change in the rolling speed of the roll mill is required.

6. A continuous mill plant comprising:

at least one alternating current motor;

at least one rolling mill having a rolling speed ratio value of less than 3.0 driven by the alternating current motor, the rolling mill capable of being driven at different rolling speeds;

frequency converter means connected to the alternating current motor, the frequency converter means providing power and output frequencies to the alternating current motor, the revolution per unit of time of the alternating current motor being dependent on the frequencies outputted from the frequency converter means;

speed control means connected to the frequency converter means for controlling the output frequencies of the frequency converter means to modify the rolling speed ratio value of the rolling mill between 3.0 and 10.0;

wherein the speed control means, by adhering to the rolling speed ratio value between 3.0 to 10.0, is capable of varying the rolling speed of the alternating current motor to provide appropriate rolling speeds to the rolling mill for producing steel plates of different thicknesses.

7. The mill plant of claim 6, further comprising reduction gears interposed between the rolling mill and the alternating current motor for transmitting the power from the motor to the rolling mill.

* * * * *